US008585258B2

(12) United States Patent
Ham

(10) Patent No.: US 8,585,258 B2
(45) Date of Patent: Nov. 19, 2013

(54) OUTDOOR LED LIGHTING APPARATUS

(75) Inventor: Byung Il Ham, Rancho Palos Verdes, CA (US)

(73) Assignee: Byung II Ham & In Sook Ham Trustees, Ham Fam Trust, Rancho Palos Verdes, CA (US)

( * ) Notice: Subject to any disclaimer, the term of this patent is extended or adjusted under 35 U.S.C. 154(b) by 150 days.

(21) Appl. No.: 13/354,192

(22) Filed: Jan. 19, 2012

(65) Prior Publication Data

US 2013/0188371 A1 Jul. 25, 2013

(51) Int. Cl.
*F21V 33/00* (2006.01)

(52) U.S. Cl.
USPC ..... 362/373; 362/431; 362/414; 362/294

(58) Field of Classification Search
USPC ..... 362/294, 373, 249.02, 414, 431, 218
See application file for complete search history.

(56) References Cited

U.S. PATENT DOCUMENTS

| | | | | |
|---|---|---|---|---|
| 8,226,273 | B2 * | 7/2012 | Lai | 362/294 |
| 8,319,408 | B1 * | 11/2012 | Horng | 313/46 |
| 8,425,085 | B2 * | 4/2013 | Van Laanen et al. | 362/294 |
| 2007/0086196 | A1 * | 4/2007 | Wong | 362/294 |
| 2009/0129092 | A1 * | 5/2009 | Chen | 362/294 |

* cited by examiner

*Primary Examiner* — Laura Tso
(74) *Attorney, Agent, or Firm* — Cislo & Thomas, LLP

(57) ABSTRACT

An outdoor LED lighting apparatus which includes a housing unit having a main body or main housing and a lower cover, and at least one LED module provided in the interior of the housing unit. The housing unit is configured to enable air to flow into and out of the interior of the unit via a convection cooling arrangement provided between the main body of housing and the lower cover of the housing.

21 Claims, 17 Drawing Sheets

OUTDOOR LED LIGHTING APPARATUS

FIELD OF THE INVENTION

The present invention relates generally to an outdoor light-emitting diode ("LED") lamp, and more particularly to high power types of outdoor LED lamps using a plurality of LEDs operating at high wattage such as streetlamps for lighting public streets, parks and other public areas.

BACKGROUND OF THE INVENTION

Prior art streetlights have typically used high pressure mercury lamps, sodium lamps, metal halide lamps, and induction lamps. These lamps have worked well in the field proving to be bright and reasonably reliable. Each of the abovementioned types suffers to a greater or lesser degree from the following disadvantages. The prior art lamps have a strong tendency to scatter light in all directions. Thus, high power consumption is required to maintain a desirable degree of luminescence on the ground where the light is needed.

Recently, LED street lamps have begun to replace older styles of lamps because LED lamps are able to produce light output equal or greater than that of conventional mercury, sodium and induction lamps and the output is substantially more directional, i.e. the light output suffers from significantly less scatter. In addition, LED lamps consume substantially less power than older types of lamps and are capable of having a much longer service life.

LEDs also have certain drawbacks. In particular, the high level of luminescence required in a street lamp cannot be met by the use of a single light emitting diode. In order to achieve luminescence comparable to mercury, sodium, or induction street lamps, numerous LEDs are required to be packaged in a single light housing. For example, a plurality of LEDs may be arranged on a circuit board (module) in a series or parallel circuit and several such boards or modules may be incorporated in a single lamp housing.

When LED lighting systems comprising modules composed of a plurality of light emitting diodes are turned "on" for long periods of time, however, they tend to generate a substantial amount of heat. LEDs are well known to be sensitive to heat. An excessive amount of heat, over a long period of time, may cause the structures forming the LED module to fail or to deteriorate and therefore negatively affect the brightness and service life of the LED lamp. LEDs are prone to heat related failures because the circuit boards to which they are mounted are generally poor conductors of heat. It is now common for LED lamps intended for lighting public areas to operate within the range of 50 to 300 watts. Operation at such wattage levels is sufficient to degrade the individual LEDs which make of modules contained in the lamp unless adequate cooling is provided.

Accordingly, there is a need in the art for streetlamp housings which include cooling structures to dissipate the heat generated from the LEDs. There is also a need in cold weather climates to prevent ice from forming around and bridging the AC contacts found within a streetlamp.

SUMMARY OF THE INVENTION

The LED streetlamp of the present invention solves the problems of the prior art by providing air flow passages through the lamp housing to transfer heat away from the LED modules by convection. The LED streetlamp includes a housing unit having a main body or main housing, a lower cover, a mast compartment cover, and at least one LED module provided in an interior of the housing unit. The housing unit is is configured to enable air to flow into and out of the interior of the unit via features which provide for convection cooling of the LED modules.

In the exemplary embodiment of the present invention streetlight, an air flow space is provided between an exterior side of at least one of the upwardly extending side walls of the lower cover and an interior side of at least one of the downwardly extending side walls of the main body. Preferably, an air flow space is provided between the exterior sides of at least two of the upwardly extending side walls of the lower cover and corresponding interior sides of at least two of the downwardly extending side walls of the main body.

The exemplary embodiment of the present invention also features one or more top air circulation openings, which are formed through a top wall of the main body. Correspondingly, one or more air circulation caps is provided at each air circulation opening to prevent water and dust from entering the housing unit. The combined area of the top air circulation openings should be within the range of about 25% of the surface area of an LED module to about 75% of the surface area of an LED module.

DETAILED DESCRIPTION OF THE INVENTION

Figure 1:
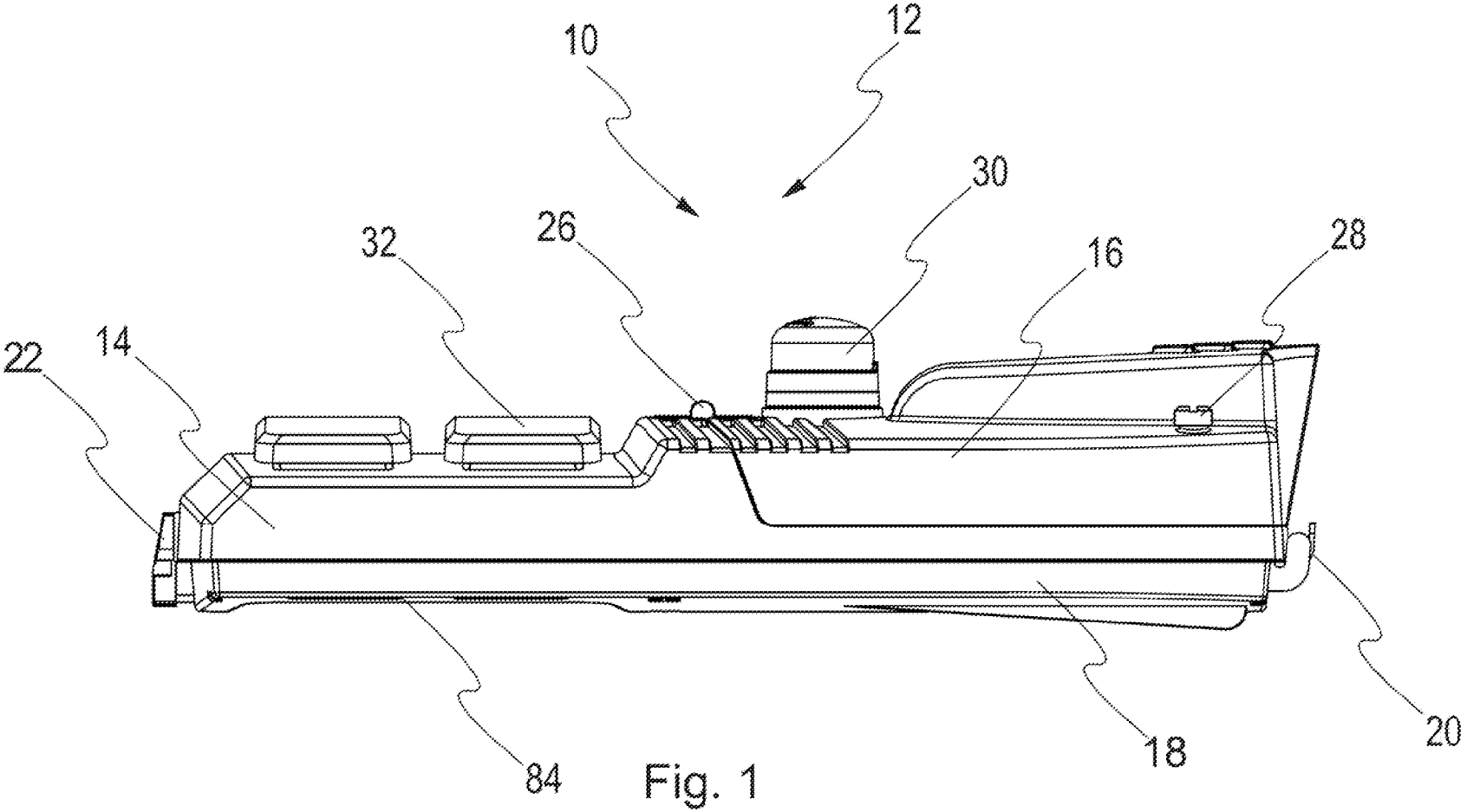
FIG. 1 shows a side elevation view of a streetlamp according to an embodiment of the present invention.
Figure 2:
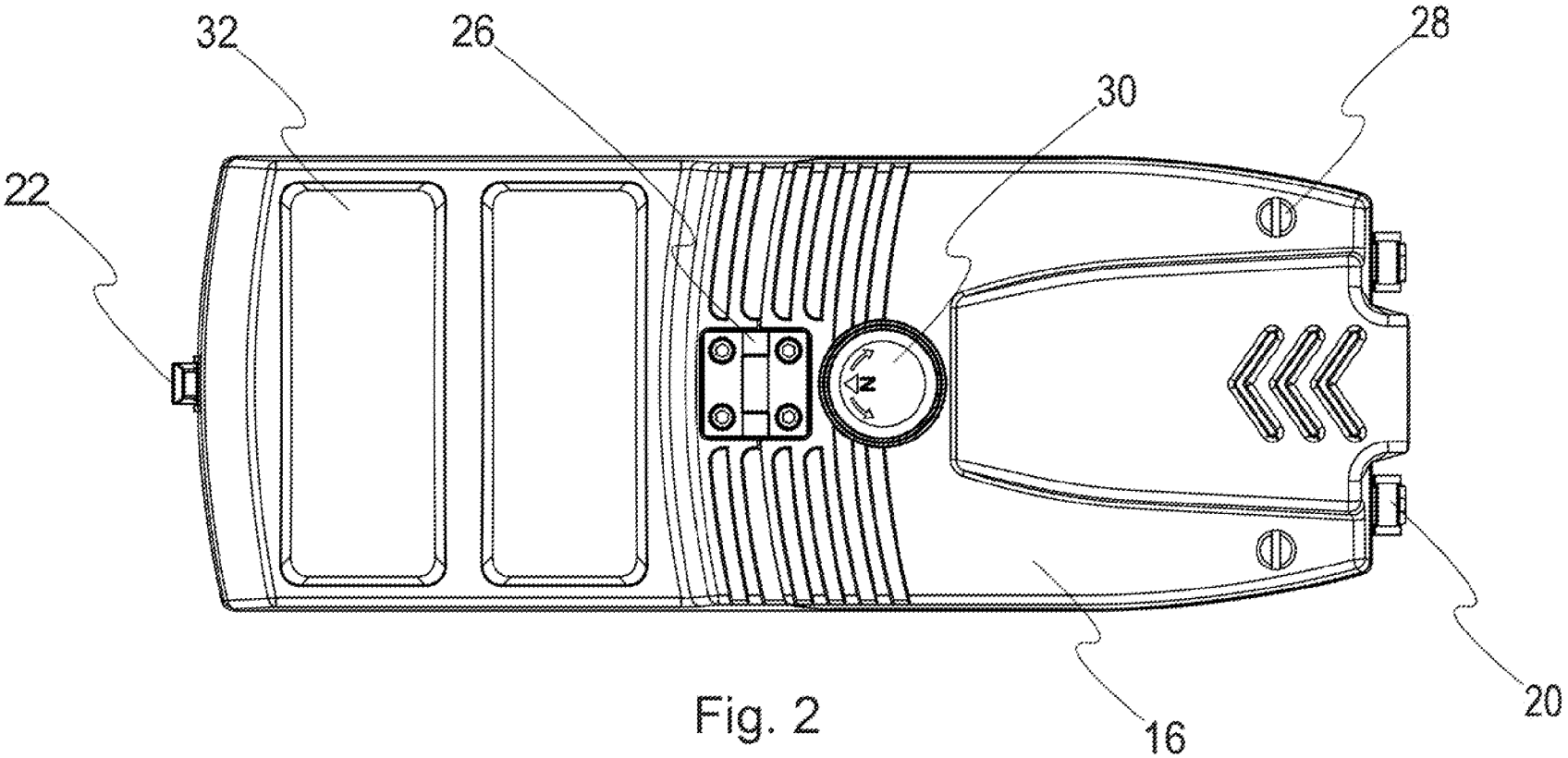
FIG. 2 shows a top plan view of the streetlamp of FIG. 1.

Referring now to FIGS. 1-9, the present invention 10 is a streetlamp suitable for all outdoor use in all types of whether and particularly in cold climates. The streetlamp 10 includes a housing 12 which comprises a main body or main housing 14, a mast compartment cover 18 and the lower cover 16.

The main body 14, mast compartment cover 16, and the lower cover 18 may be constructed of engineering plastics or die cast metals such as aluminum, zinc and alloys thereof. These and other suitable materials are known to those of skill in the art. In the exemplary embodiment, the main body 14, a mast compartment cover 16 and lower cover 18 are constructed of engineering grade plastics. There is no requirement that the main body 14, mast compartment cover 16 and lower cover 18 be constructed of the same material. In certain applications or simply for reasons of manufacturing efficiency, it may prove desirable to make some components from plastic and some from metallic materials.

Figure 3:
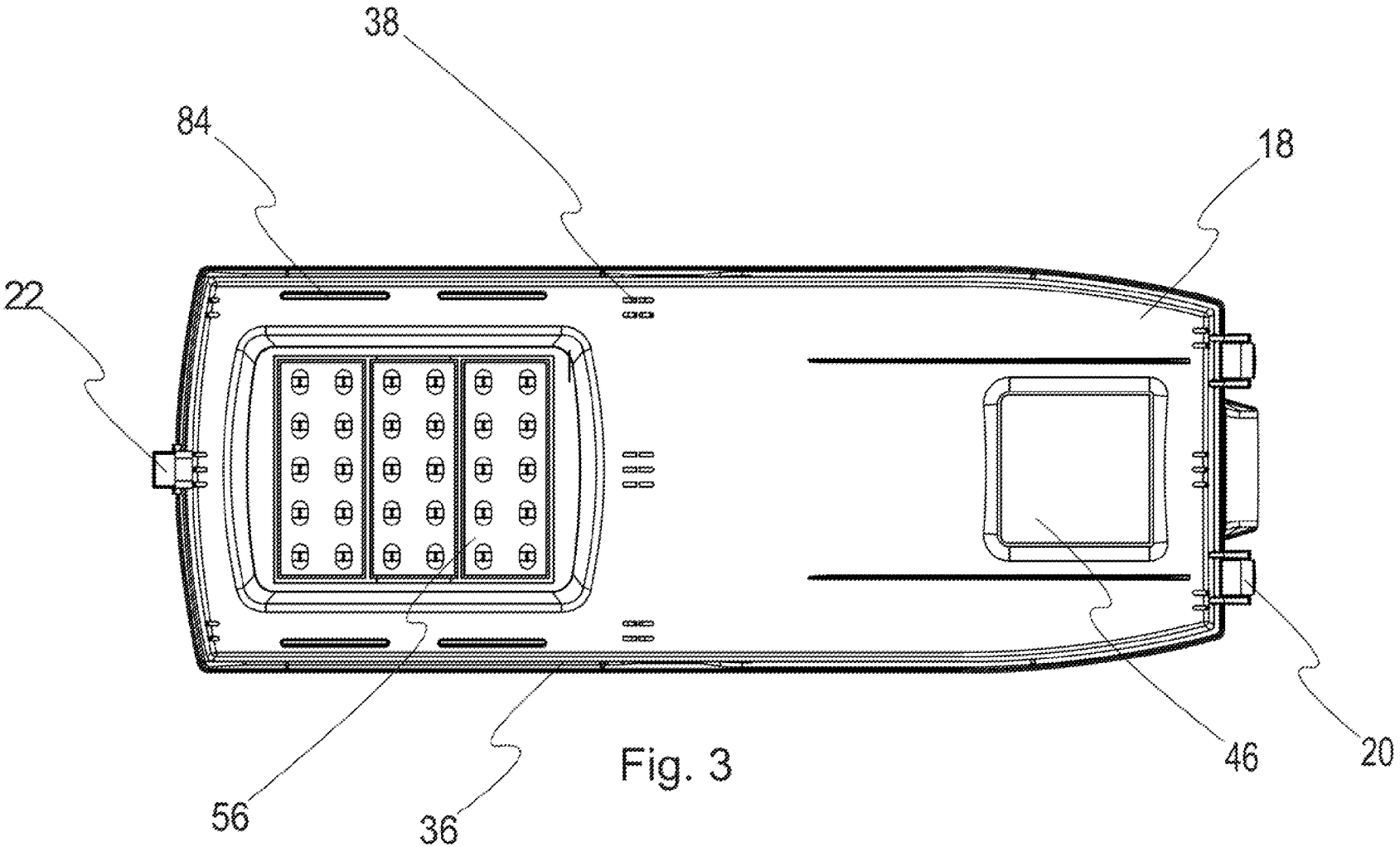
FIG. 3 shows a bottom plan view of the of the streetlamp of FIG. 1, showing an opening provided at a bottom wall of the lower cover, through which light from an LED module is projected.
Figure 5:
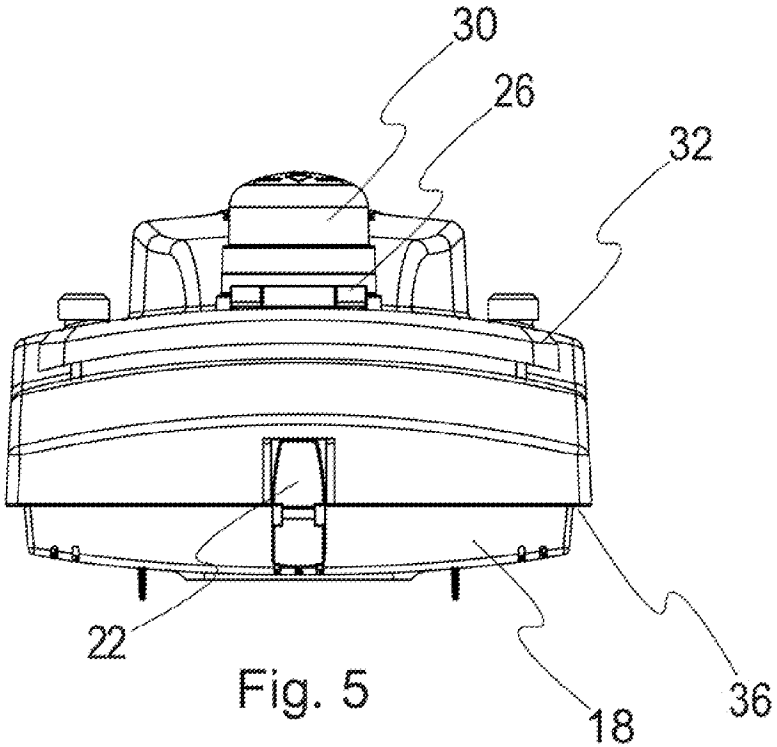
FIG. 5 shows a front elevational view of the of the streetlamp of FIG. 1
Figure 11:
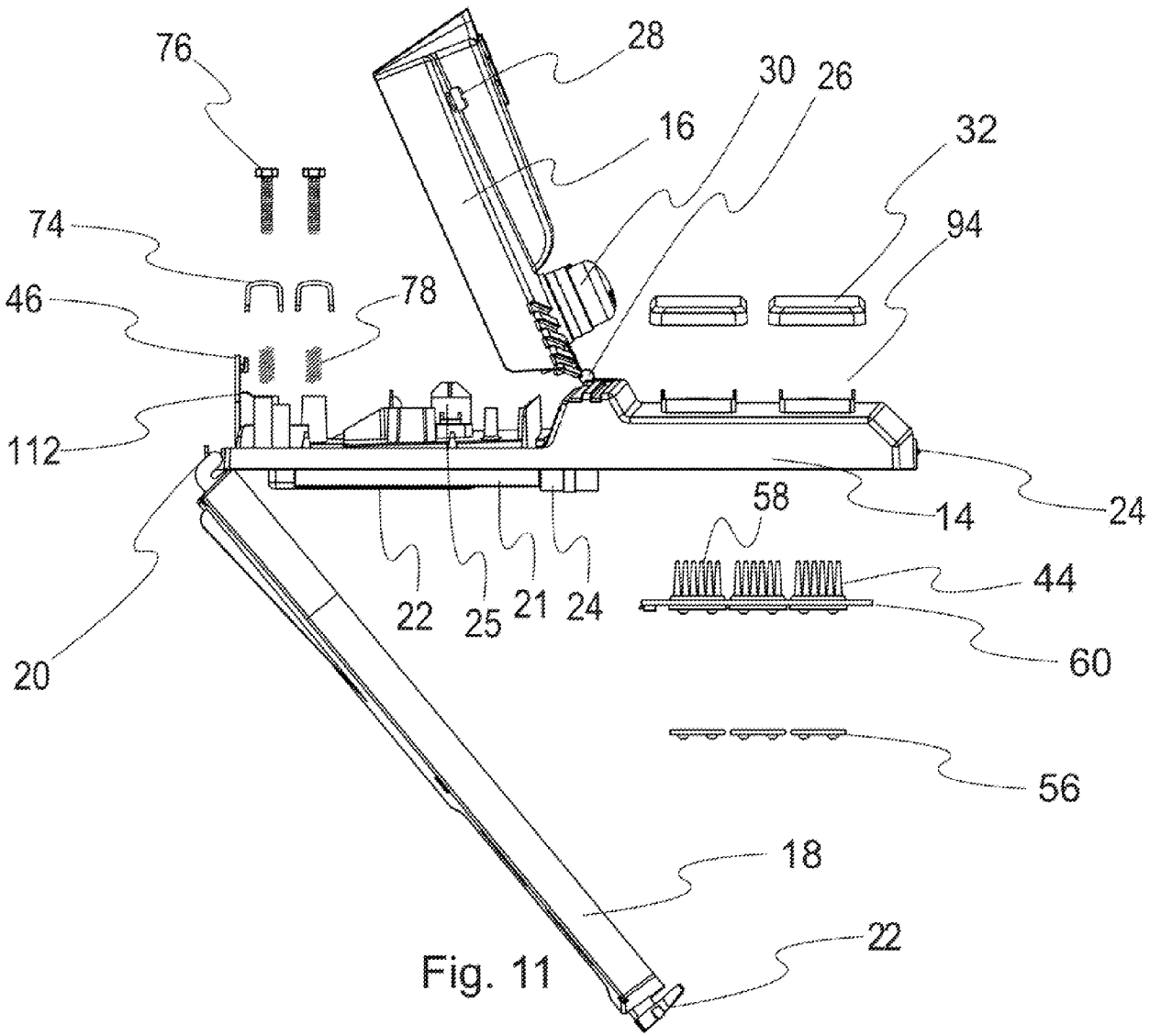
FIG. 11 shows an exploded side perspective view of the streetlamp of FIG. 1.

The lower cover 18 is pivotally attached to a rear portion of the mast compartment cover 16 via a pair of hinges 20, as shown in FIGS. 1, 3 and 5. The lower cover 18 is rotateably movable between an open position and a closed position. (See FIGS. 10-13). With the lower cover 18 rotated to its open position, ready access is provided to the internal components of the streetlamp 10. (See FIGS. 10-13.) This ready access to the streetlamp's internal electrical components allows for easy maintenance of the lamp by servicing crews. The lower cover 18 is maintained in the closed position via a latch 22 attached to the lower cover 18. The latch 22 engages with a latch holder 24 formed on the main body 14. (See FIG. 11.)

With continued reference to FIGS. 1-9, a mast compartment cover 16 is connected at its front end to the main body 14 by a hinge 26. The mast compartment cover 16 is connected to the main housing 14 at its rear end by a pair of knobs 28 with screw thread shanks. The knobs 28 are of sufficient size so as to be able to be removed by a maintenance worker with his fingers. Screwdriver slots are provided in the knobs 28 because in cold weather climates, ice buildup between the threads on the shank of knobs and the mating threads in main body 14 may freeze the screws to the housing. Mounted to the mast compartment cover 16 is a light sensor 30 which turns the lamp on and off at sunset and sunrise, respectively. The light sensor 30 is attached to the mast compartment cover by a socket 114 (best shown in FIG. 13.)

Figure 4:
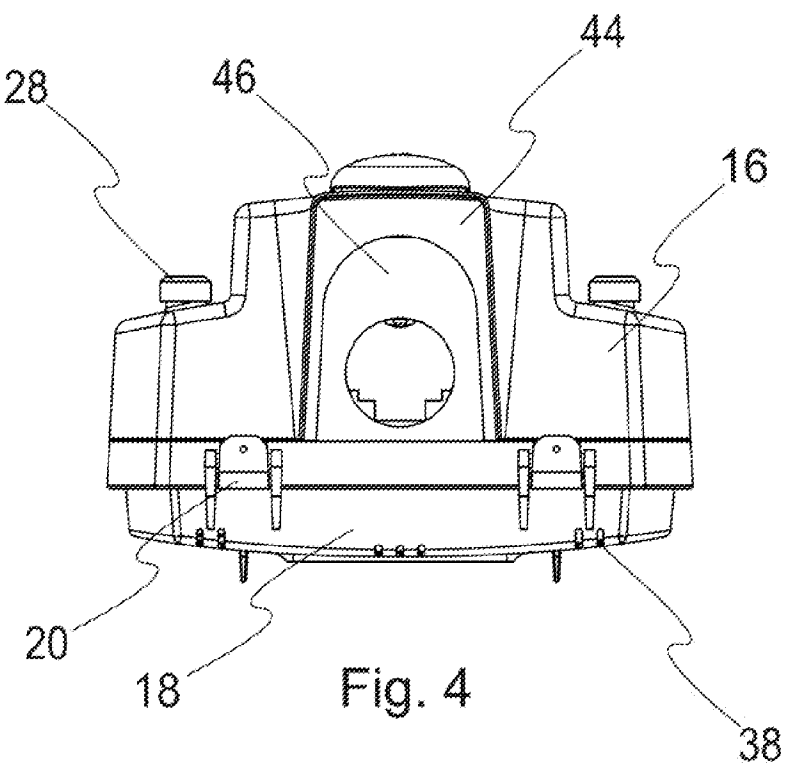
FIG. 4 shows a rear elevational view of the streetlamp of FIG. 1.
Figure 6:
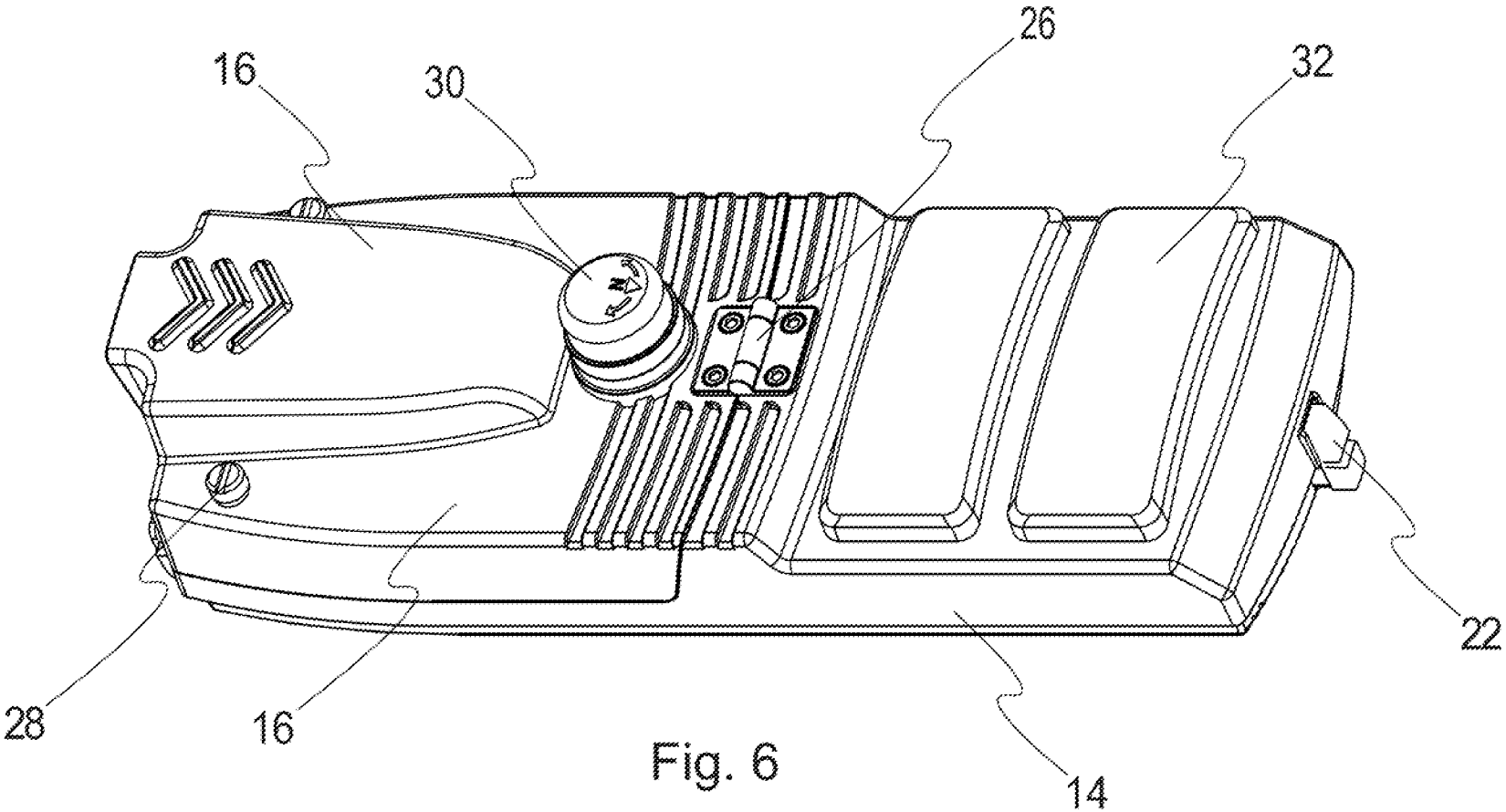
FIG. 6 shows a left, top-frontal, perspective view of the streetlamp of FIG. 1.
Figure 7:
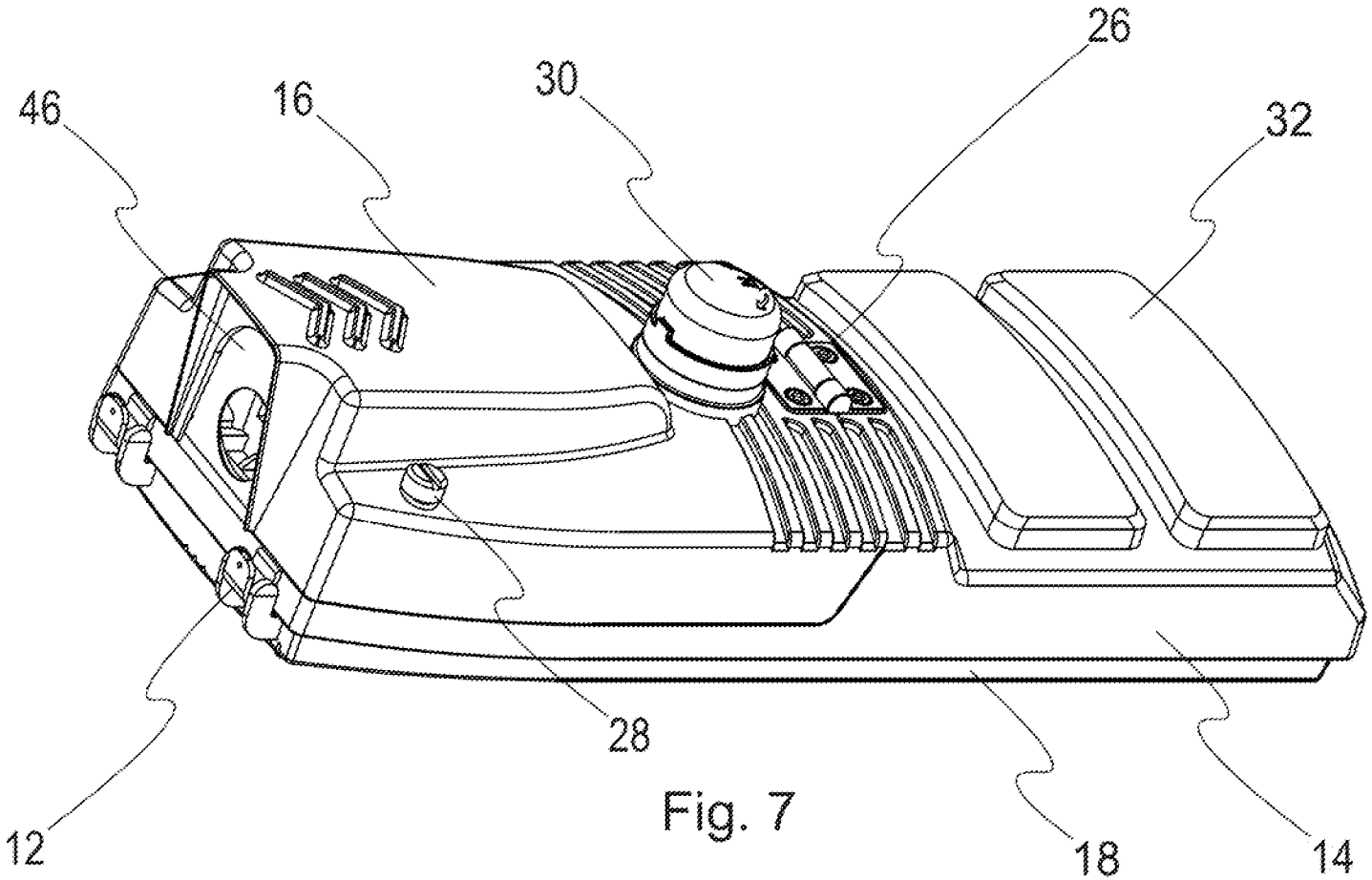
FIG. 7 shows a right, top-rear, perspective view of the streetlamp of FIG. 1.
Figure 8:
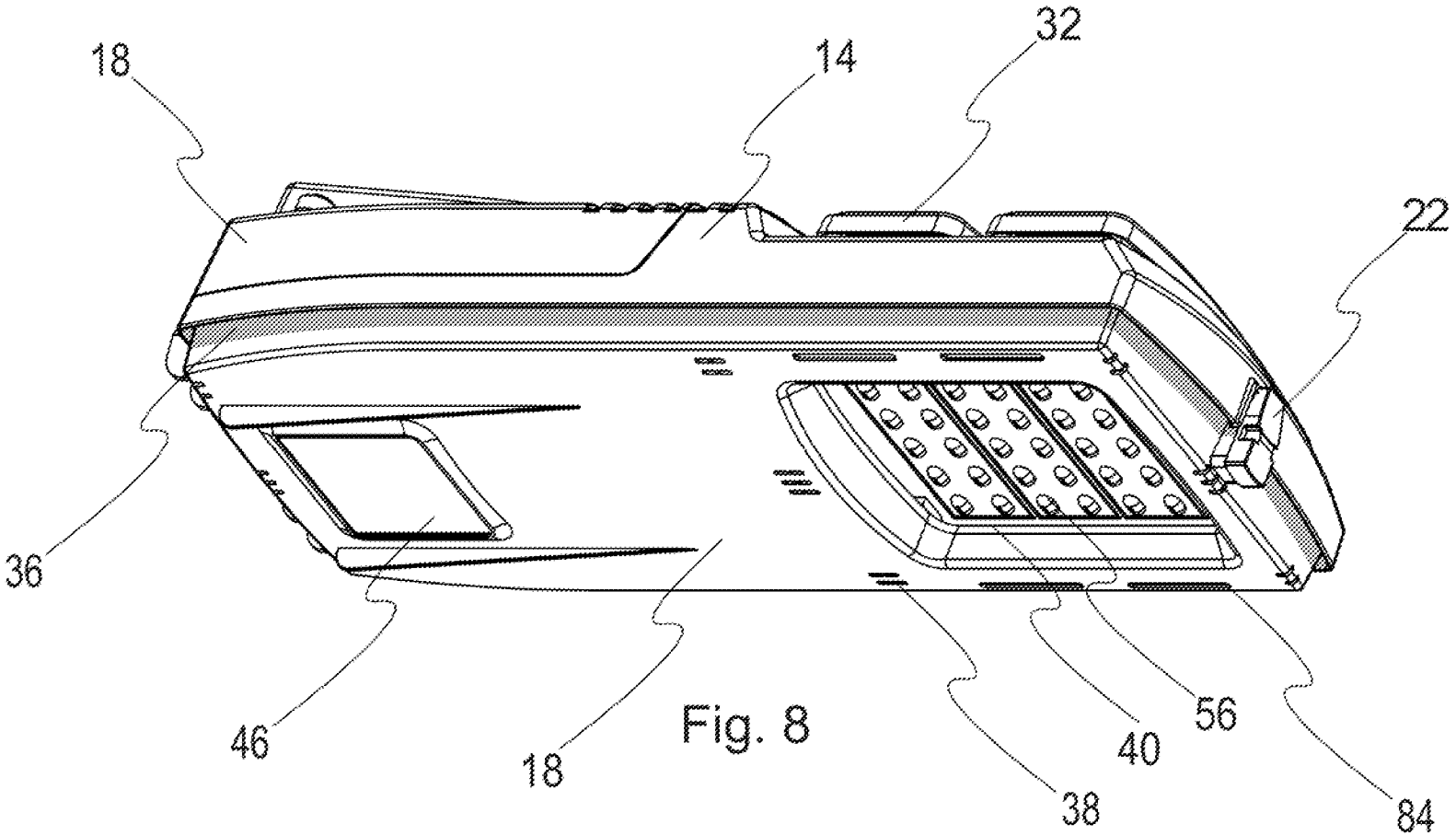
FIG. 8 shows a left, bottom-front perspective view of the streetlamp of FIG. 1.

With reference to FIGS. 1-9, air circulation control caps 32 are shown. The caps 32 cover openings 34 (best shown in FIG. 10) and are in fluid communication with air induction slots or apertures 84 and water drain holes or apertures 38, both of which are located in a bottom plate 42 of the lower cover 18. Further included in the bottom plate 42 of the lower cover 18 is an opening 40 though which light from at least one LED module 44 is projected. A label 47 identifying the product and its manufacturer may optionally be included at the rear end of the lower cover 18. With particular reference to FIG. 4, at the rear end 44 of the mast compartment cover 16 is a bird guard 46. The bird guard 46 is, in the exemplary embodiment, a rubber seal which surrounds a light pole mast (not shown) and keeps out small birds and insects, particularly wasps, as well as seals the mast compartment 48 (see FIG. 10) from water intrusion.

Figure 9:
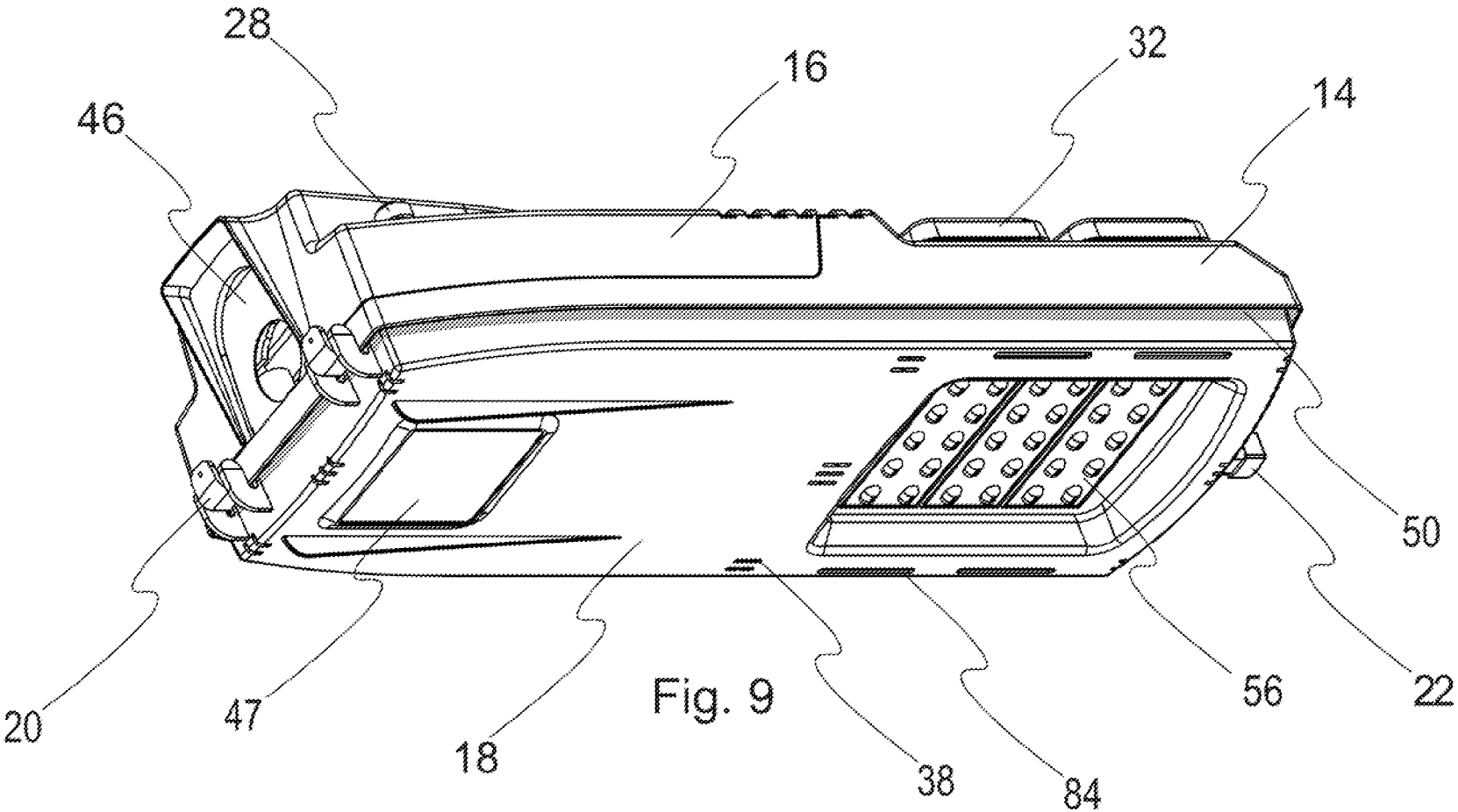
FIG. 9 shows a right, bottom-rear perspective view of the streetlamp of FIG. 1.
Figure 10:
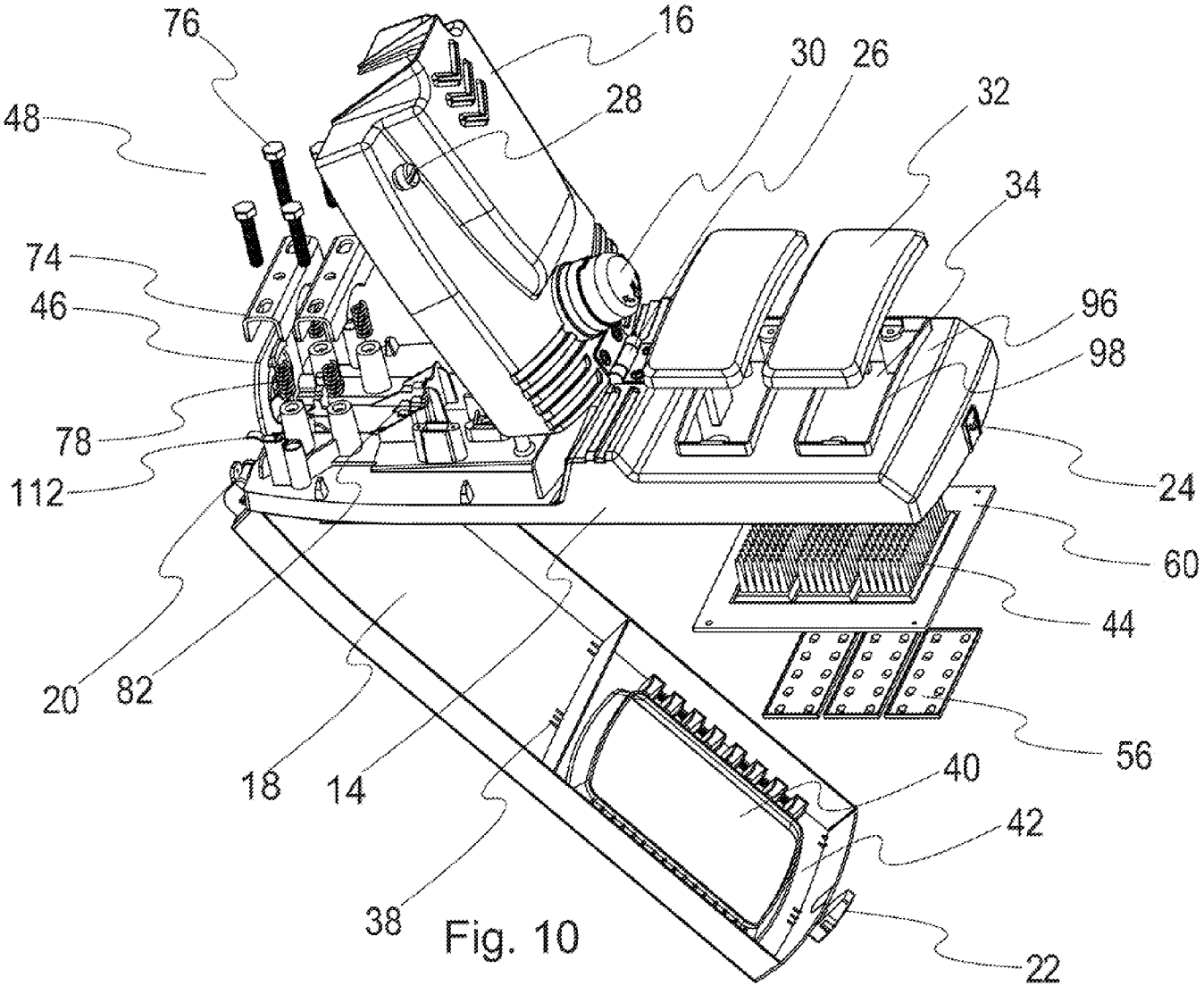
FIG. 10 shows an exploded left, front-side perspective view of the streetlamp of FIG. 1.

Referring now to FIG. 9, an air circulation gap 36 between the interior walls of the main body 14 and the lower cover 18 is shown. In the exemplary embodiment, the air circulation gap 36 extends around the periphery of the main body 14 and the lower cover 18.

Figure 12:
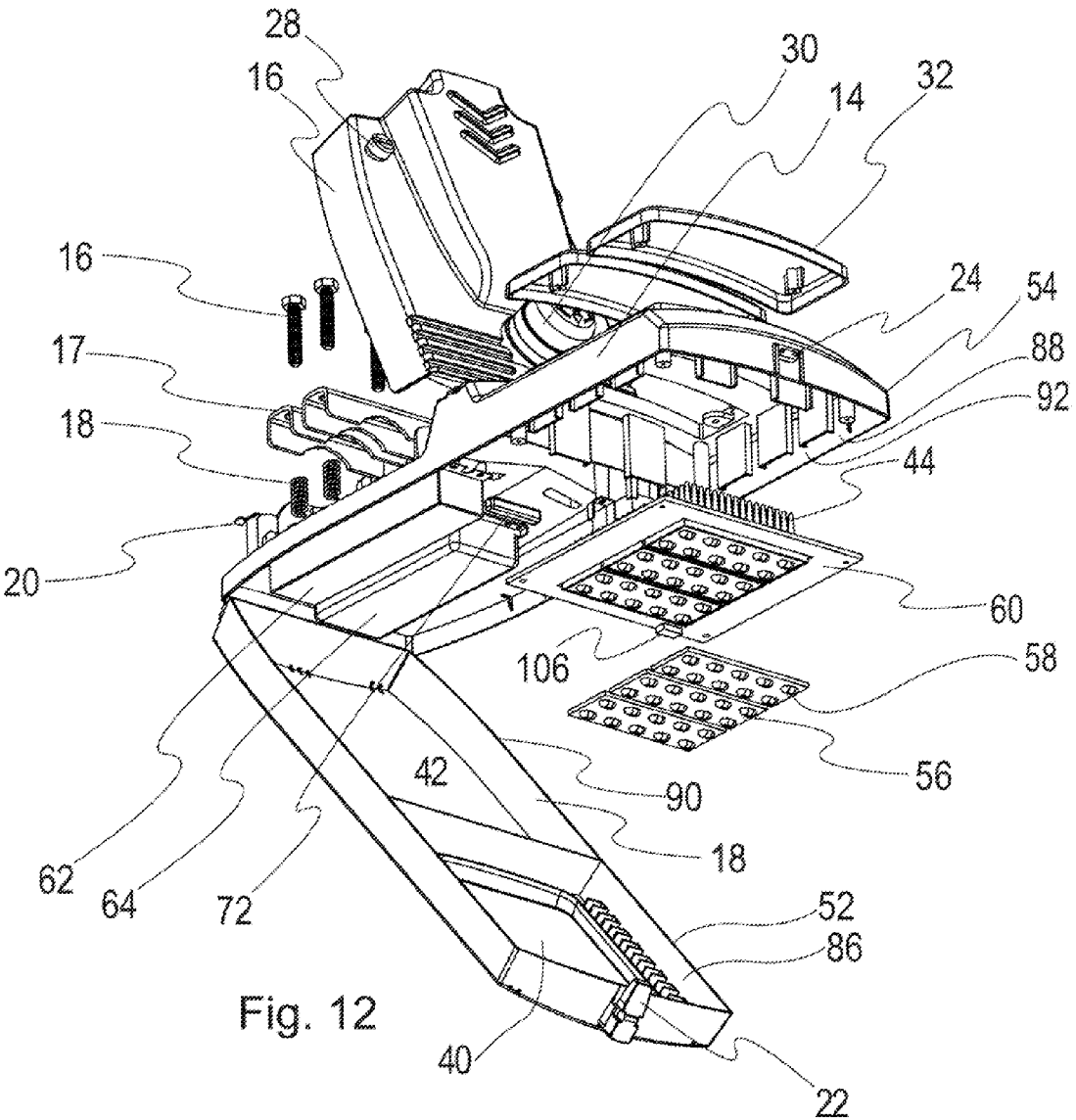
FIG. 12 shows an exploded right, front-bottom perspective view of the streetlamp of FIG. 1.
Figure 13:
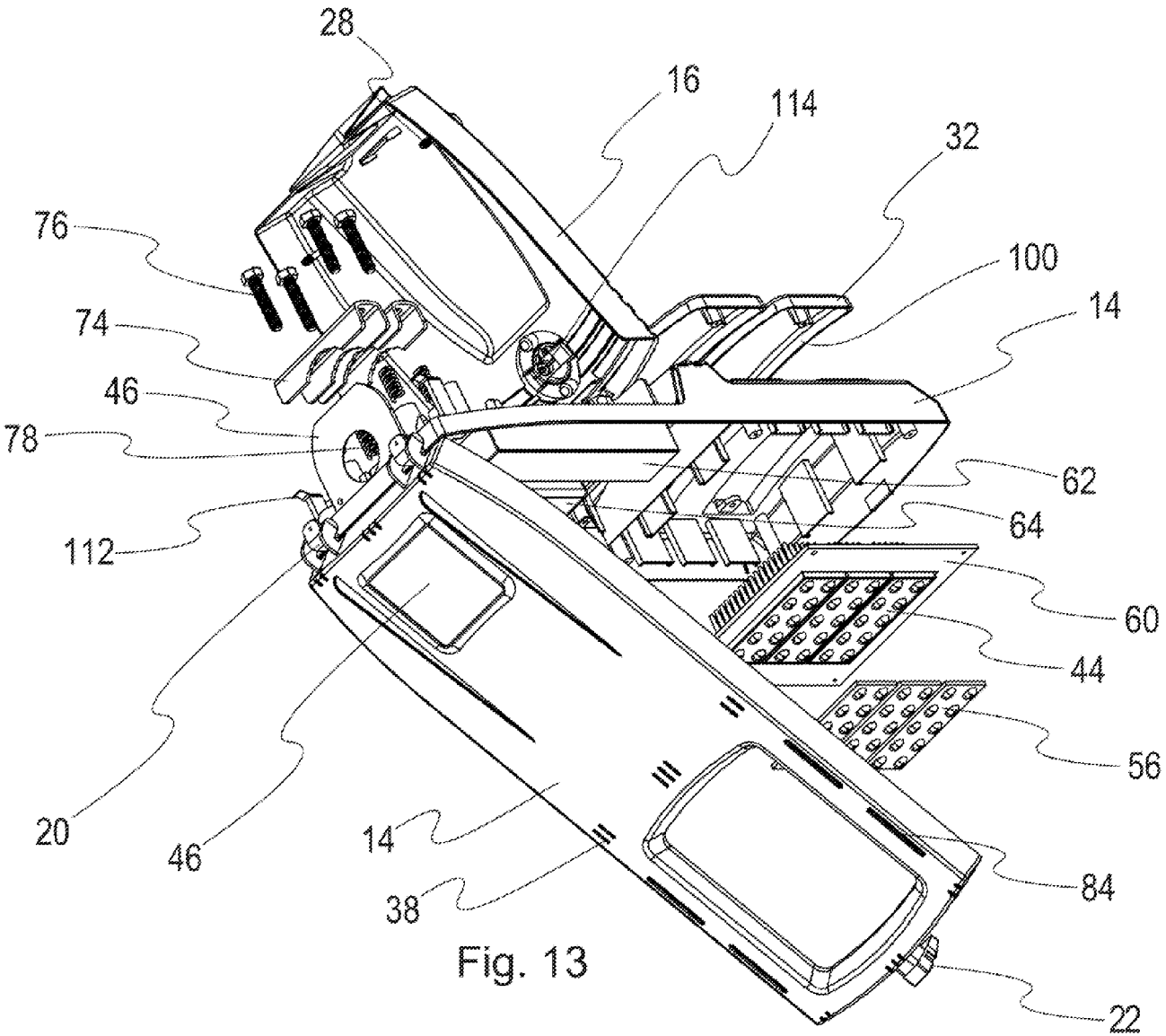
FIG. 13 shows an exploded left, rear-bottom perspective view of the streetlamp of FIG. 1
Figure 14:
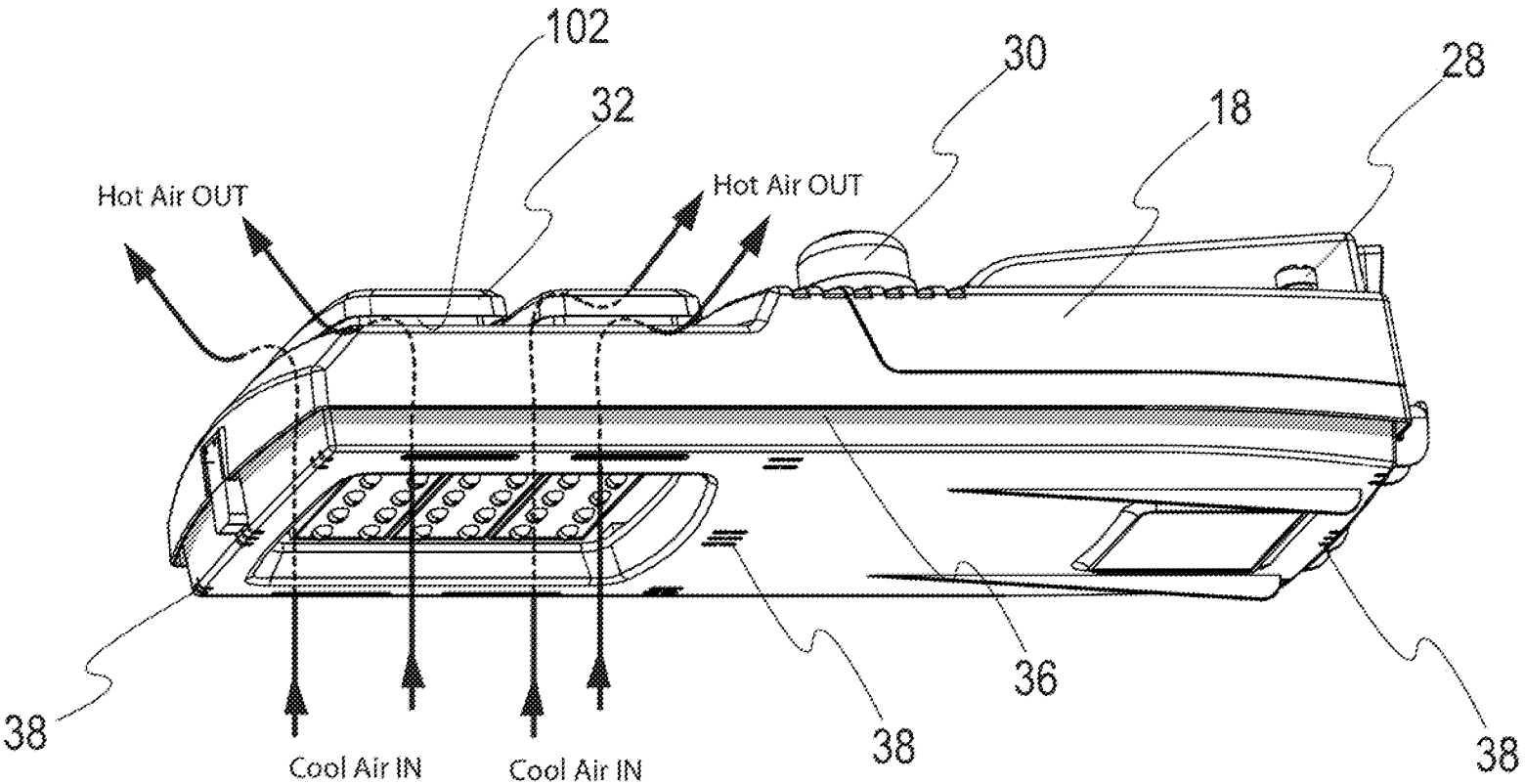
FIG. 14 shows a right, side perspective view of the streetlamp of FIG. 1 illustrating air flow paths for convection cooling of the streetlamp of the present invention.

Referring to FIGS. 9-13, and 16-17, the internal details of the streetlamp 10 of the present invention are shown. With particular reference to FIG. 12, the lower cover 2 is split into two main compartments, i.e. a forward compartment 52 and a rear compartment 54. Formed into the bottom plate 42 of the lower cover 18 is the opening 40. Within this opening resides a multiple distribution optic 56, which is essentially a clear plate with a plurality of lenses 58 formed therein for focusing the light output from the LEDs 44 towards the ground.

Within a bottom portion of the main body 14 are attachments for the at least one LED module(s) 44, each of which includes an integrated heat sink. The plurality of modules are captured within a frame 60. Also included in the bottom portion of main body 14 are the lamp electronics which comprise a step-down AC to DC voltage transformer 62, an LED driver 64, and a surge suppressor 66. These components may hereinafter be referred to as the lamp "ballast."

Figure 16:
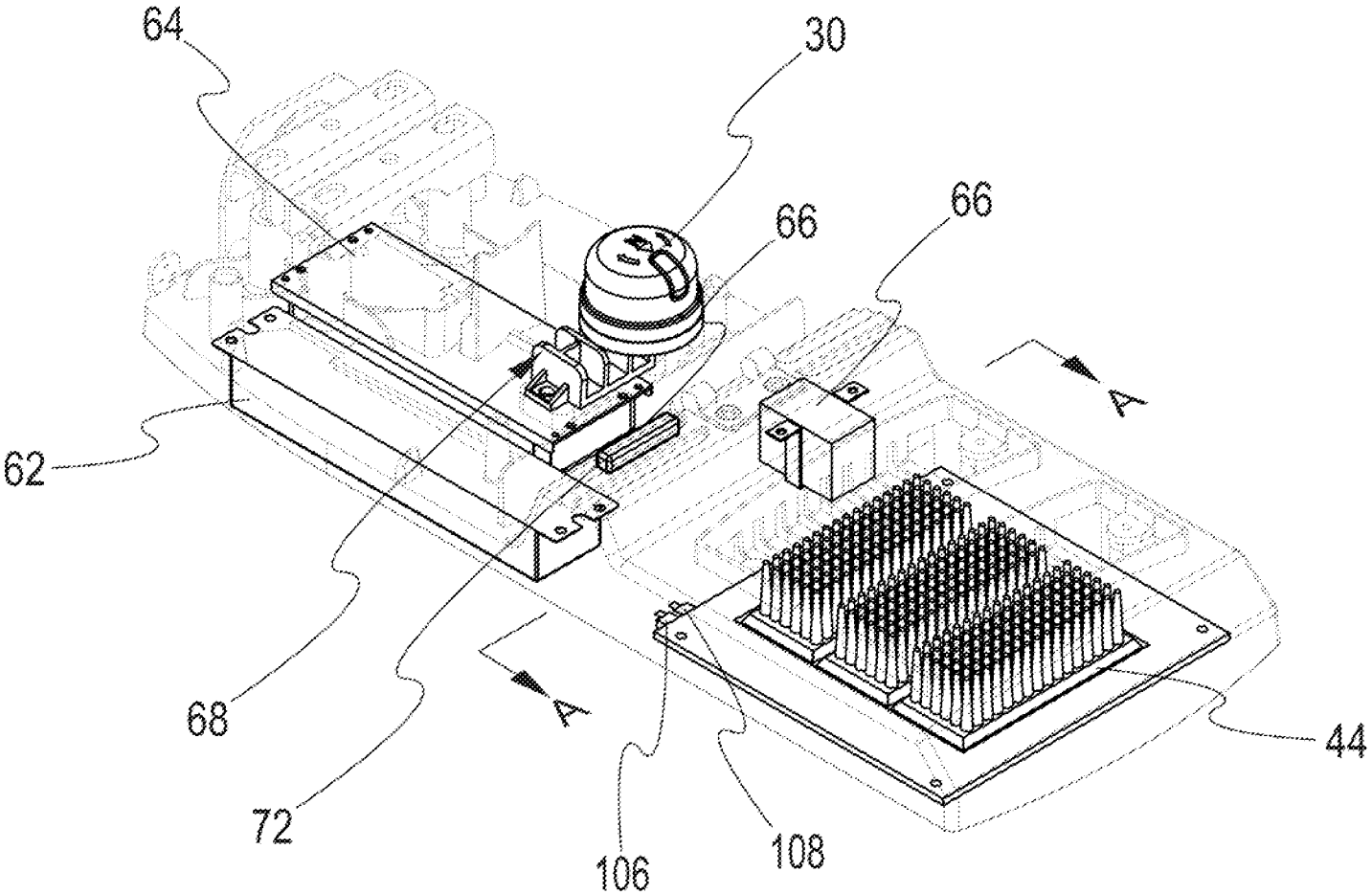
FIG. 16 shows a top, side perspective view of the streetlamp of FIG. 1, with the lamp housing shown in hidden line and electrical components contained within shown in solid line.

Referring now to FIG. 16, a pair of AC contacts 70, via an AC terminal block 68, bring line power into the streetlamp 10. As will be discussed further below, a heater 72 for frost prevention and melting ice in cold climates is provided adjacent the AC contracts 70. The heater 72 functions, among other things, to keep the AC contacts free of ice during winter conditions Referring again to FIGS. 9-13, on the upper side of main body 14 in the area enclosed by the mast compartment cover 16, are light pole mast clamps 74, which connect to the main body 14 via screws 76 which threadably attach to heli-coil inserts 78 which are inserted into bosses 50 formed in the main body 14. The mast clamps in combination with a set of vertical adjustment steps 82 are adjustable to accommodate a wide variety of streetlight masts. Masts used to mount streetlights are generally round tubes of varying diameters. Masts with diameters of about 1¼" to about 2½" are in common use in various locales in the United States. The mast-clamps 74 and adjustment steps 82 of the present invention streetlight 10 feature adjustability sufficient to accommodate the aforementioned range of diameters. This range of adjustability eliminates the need for streetlight installation and service crews to carry several sizes of clamps to accommodate the various diameters of masts in common use.

Operation of the Present Invention Streetlight

Referring now to FIGS. 5, 9, 12 and 14, the main body or housing 14 and the lower cover 18 are configured to enable air to flow into and out of the interior of the streetlamp to cool the LED modules 44. Air flows into the streetlamp 10 via an air flow spacing or gap 36 provided between the main body 14 and the lower cover 18, as well as via the air induction slots 84. The air flow gap 36 is provided between an exterior side 86 of the upwardly extending side walls 90 of the lower cover 18 and an interior side 88 of the downwardly extending side walls 92 of the main body 14. (See FIG. 12.) The air induction slots 84 are formed into the bottom surface 42 of the lower cover 18.

The main body 14 is configured to enable air to flow out of the interior of the housing 12 via the air circulation outlets 34 provided at a top surface 94 of the main body 14. In the exemplary embodiment, each opening air outlet 94 is rectangular in shape. More specifically, the rectangular shaped openings are formed at a surface 96 of the main body 14. Each of the rectangular top air circulation openings 94 has a raised peripheral ridge 98 provided on each of the sides of the openings 94. As will be apparent to those skilled in the art, the air outlet openings 94, need not be rectangular but could square, round, triangular or of any other desired shape.

In the exemplary embodiment, the combined surface area of the air circulation outlets 94 is approximately 75% of the combined surface are of the LED modules 44. Depending upon climate and lamp wattage, the inventor has found that air outlet openings 94 with combined surface areas in range of about 25% to about 75% of the LED module surface areas are typically sufficient to provide effective cooling. In particularly hot climates, the air outlet openings 94 may require a surface area of about 100% of the surface are of the at least one LED modules 44.

The air circulation caps 32 are provided to cover the air circulation outlets 94 to prevent dust and water from entering the interior of the streetlight 10. In the exemplary embodiment, each air circulation cap 32 corresponds to the shape of its respective top air circulation opening 94. In the exemplary embodiment, each air circulation cap 32 is provided with a peripheral ridge 100 provided at the perimeter thereof. (See FIG. 13.) When the air circulation cap 32 is mounted to cover a respective air circulation outlet opening 94, an air gap 102 is formed between the peripheral ridge 100 of the cap 32 and the raised peripheral ridge 100 of the air outlet opening 32 to enable air to flow into and out the housing 12 of the streetlamp 10.

Referring now to FIGS. 1-13 and particularly 14, air is enabled to flow into the interior of the housing 12 starting from underneath the lower cover 18, flowing through air intake slots 84 and through the air flow spacing 36 provided between the exterior surface 86 of the upwardly extending side walls 90 of the lower cover 18 and the interior surface 88 the downwardly extending side walls 92 of the main body 14 and exit through the air outlet openings 94 provided through the top wall 96 of the main housing 14. Via this mechanism, sufficient air flow may be achieved to prohibit the temperature inside the housing 12 from rising above a certain threshold temperature, i.e. the temperature at which the at least one LED modules 44 may begin to suffer from thermal degradation. Thus, the airflow mechanism of the present invention 10 advantageously increases the service life of the at least one LED modules 44.

With reference to FIGS. 1-9, the mast compartment cover 16 is movably attached to the main body 14 via a tensioned hinge 26 for smooth opening and closing thereof. One or more tool-less type fasteners 28 may be used to fasten the mast compartment cover portion 18 to the main body 14. When the mast compartment cover 18 is moved to an opened position, the mast clamps 74, clamp screws 76 and vertical adjustment steps 82 may accessed to secure the streetlamp 10 to a streetlight mast which typically extends from a light pole. The bird cover 46 is provided rearward of the mast clamps 74 to prevent birds, bugs or water from entering the interior of the streetlamp 10.

Figure 15:
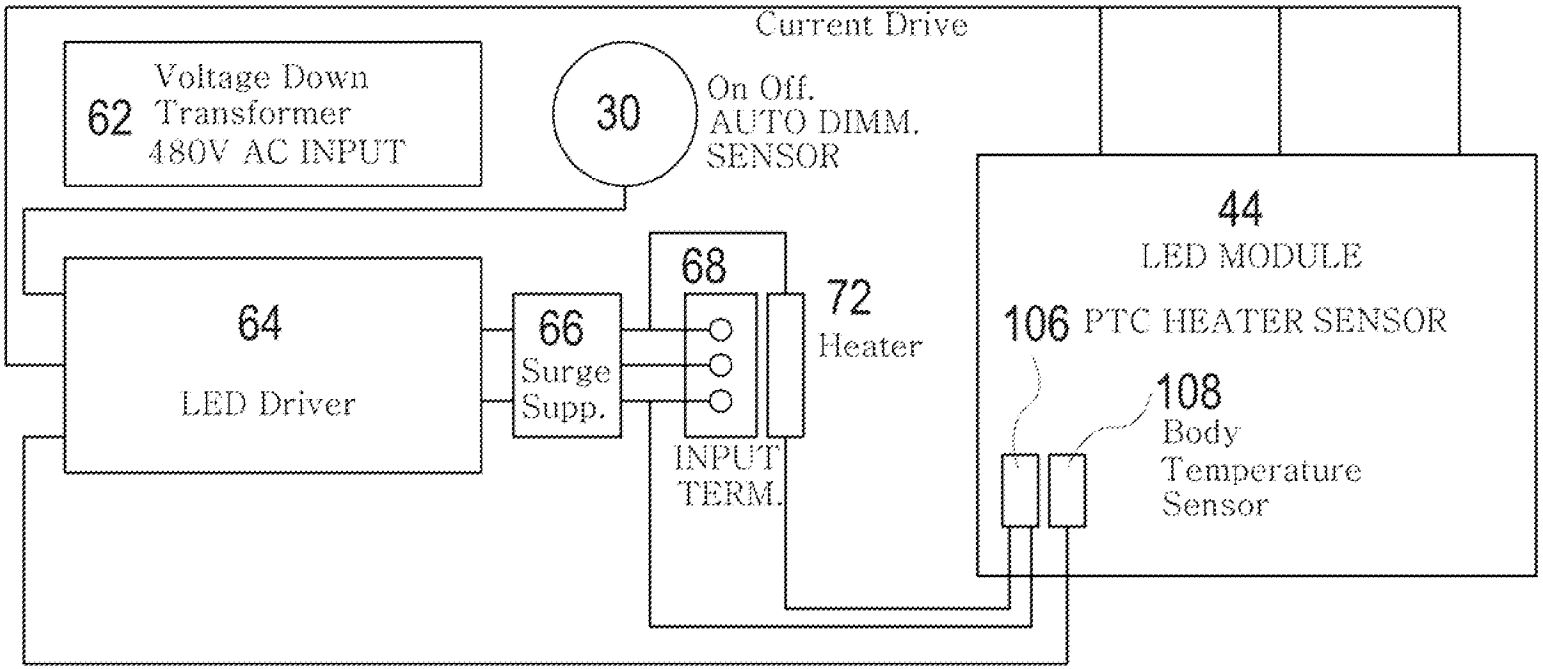
FIG. 15 shows a block diagram of electrical components contained within the housing of the lighting apparatus of the streetlamp of FIG. 1.
Figure 17:
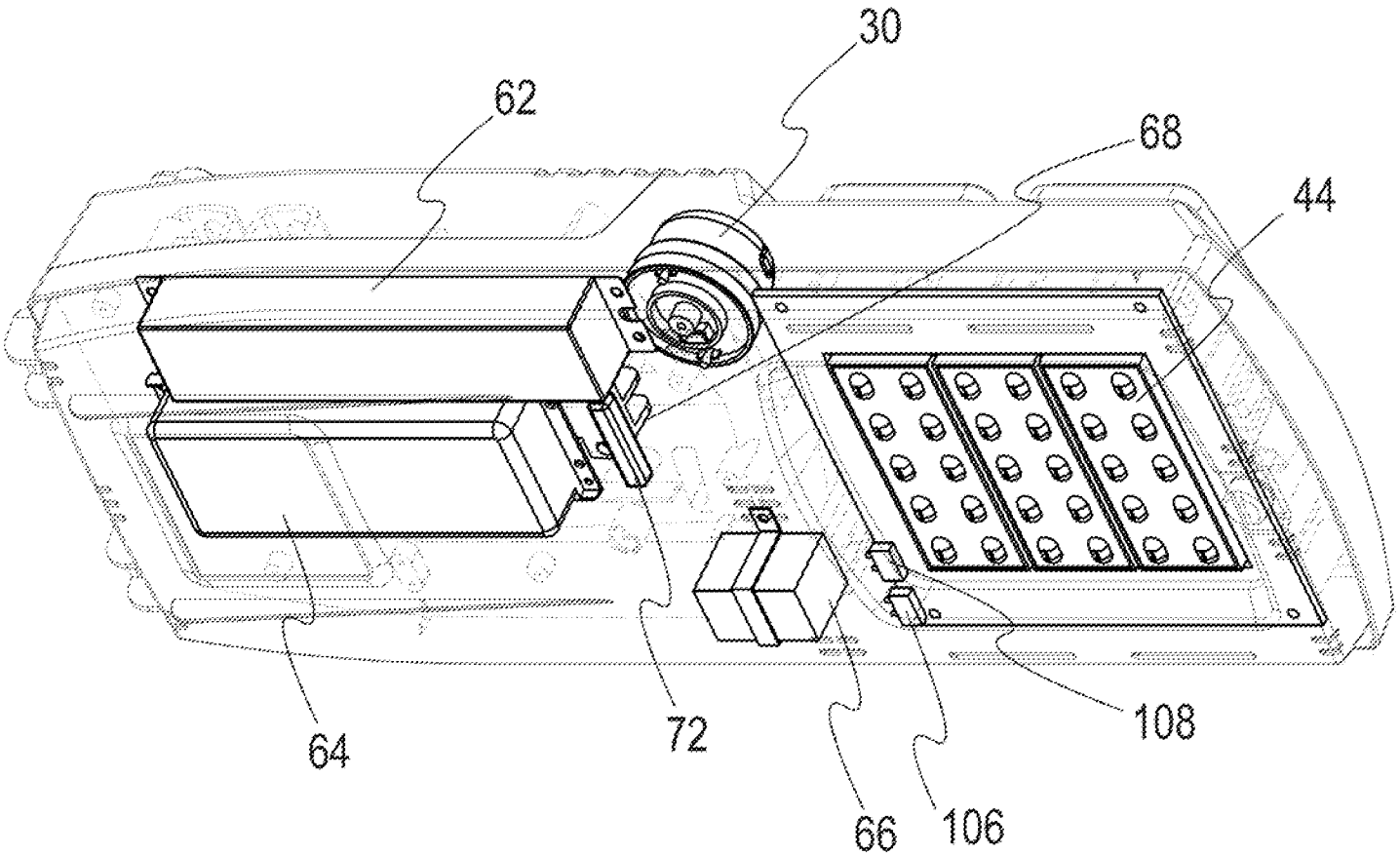
FIG. 17 shows a bottom, side perspective view of the streetlamp of FIG. 1, with the lamp housing shown in hidden line and electrical components contained within shown in solid line.

Referring now to FIGS. 15-17, the LED module 44 and integral heat sink are mounted on the LED module frame 60. Optical elements 56 with lenses 58 (see FIG. 10) cover the LEDs to distribute the light generated by the LEDs. The light sensor 30 is secured to the top of the mast compartment cover 18. The light sensor 30 is coupled to the LED driver 64 to control automatically turning on and turning off of the LED modules 44 based on the amount of light received by the sensor 30. The light sensor 30 may be covered with a transparent cap (not shown).

In the exemplary embodiment, the LED module(s) 44 are installed in the main body 14 of the streetlamp 10 and are configured to consume electrical power in a range of about 200-300 watts, which provides sufficient light output for many outdoor uses. LED modules 5 with integrated heat sinks are now commercially available with wattage ratings of about 25 to 300 watts from Samsung and Sylvania, among others. Those skilled in the art will readily understand that when less light output is needed or desired, LED modules 44 with lower wattage ratings can be substituted for those used in the exemplary embodiment.

With reference to FIGS. 1-14, water drain slots or apertures 38 are provided through the bottom wall 42 of the lower cover 18 to enable any water that may enter the housing 12 to be discharged. Likewise, air induction slots or apertures 84 may also serve as water drains due to their location in the bottom of the lower cover 18. Those skilled in the art will understand that the water drain apertures 38 and air induction apertures 84 may be openings of any suitable shape such such holes, slots, square and rectangular openings, etc.

Referring now to FIGS. 15-17, in the exemplary embodiment, the step down power supply 62 (which includes a step down transformer) converts high voltage AC line input current to low voltage DC current for provision to the LED module driver 64 to drive and supply electrical power to the LED module. Alternatively, LED drivers 64 are now available that integrate the step-down power supply 62 with the driver 64 in a single unit.

In the exemplary embodiment, a temperature or heat sensor 108 is coupled to the LED driver 64 to control the LED module(s) 44 based on an amount of heat or temperature sensed by the body temperature sensor 108. To prevent the temperature inside the streetlamp 10 from rising to a point where the temperature is sufficiently high that it can damage the LED module(s) 44, the LED driver 64 is configured to either dim or temporarily deactivate the LED module(s) 44 when the temperature of the LED module(s) exceed a certain threshold temperature.

During winter in cold climates, air temperatures often do not rise above freezing during the day. Therefore, the temperature inside the lighting apparatus can fall below the freezing point of water, possibly allowing ice to build up inside the streetlight housing 12. This can be particularly problematic if ice is formed at or near the input terminals 70 where electrical wires supplying AC power are connected. Accordingly, in the exemplary embodiment, one or more heaters 72 are provided inside the housing 12 to prevent ice from forming therein. In the exemplary embodiment, the heater 72 is positioned adjacent to the power supply unit 62. More specifically, the heater 72 is located adjacent to input terminals 70 where AC power supply electrical wires are connected.

Figure 18:
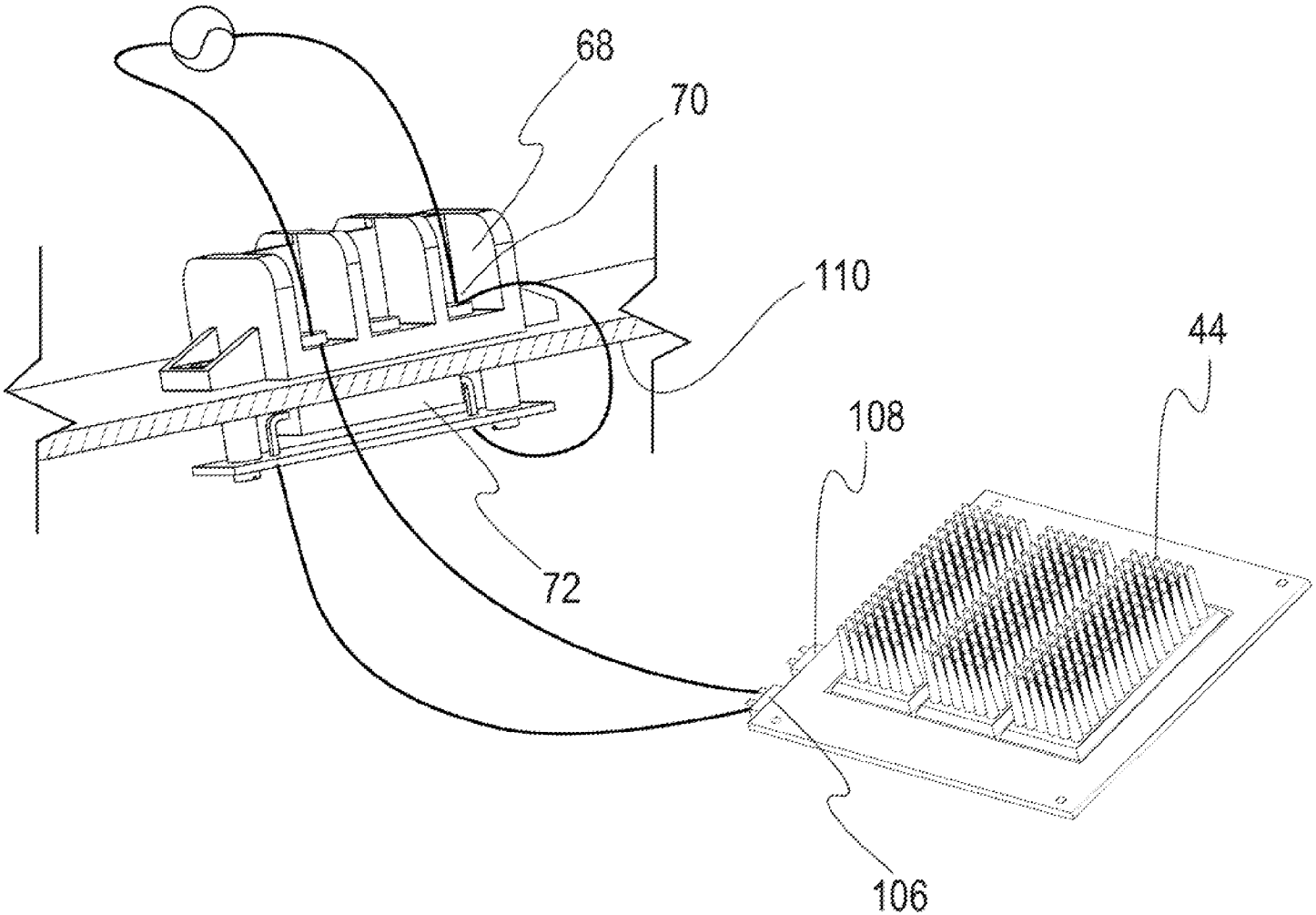
FIG. 18 shows a perspective cutaway view taken along the line A-A of FIG. 16, showing the heater input terminals and the heater mounted to the base wall of the main body and connected to the LED module, the streetlamp of FIG. 1.

The heater 72 is controlled by a temperature sensor or thermal switch 106 (see FIGS. 15 and 18). The thermal switch 106 activates the heater 72 whenever the air temperature inside the housing 12 falls below freezing (or other desired threshold temperature). This condition typically arises during the day when the LED module(s) 44 are turned off in cold climates, where the air temperature does not rise above freezing during daylight hours. The temperature sensor 106 will turn off the heater 72 when the air temperature inside the housing rises above freezing (or other desired threshold temperature). This condition occurs in cold climates, typically at night when the LED modules are turned on and during summer months when air temperature does not fall below freezing.

The primary function of the heater 72 is to prevent the formation of ice at the AC input terminals 70 of the AC terminal block 68, and more generally to prevent the formation of ice inside the lamp housing 12. Those skilled in the art will readily appreciate that the set or trigger point of thermal switch 106 may be tailored to suit local conditions.

In the exemplary embodiment, the heater 72 comprises a ceramic heater having heating elements embedded in ceramic plates. The heater 72 is mounted to a wall 110 (see FIG. 18) of the main body 14 such that a flat ceramic surface of the heater is in direct contact with the wall 110 of the main body 14. Suitable ceramic heaters are commercially available in wattages of about 1 to 5 watts and are known to those of skill in the art.

With continued reference to FIG. 18, the AC input terminals 70 are provided on a top surface of a base wall 110 of the main body 14, and the heater 72 is mounted on a bottom surface of the base wall 110 of the main body 14 directly below the input terminals 70. Thus, the base wall 110 functions to conduct the heat generated by the heater 72 to the input terminals 70 such that ice is prevented from forming at or near the input terminals. The choice of heater output will to some extent depend on whether the main housing is made of a metallic material or a plastic material.

Referring now to FIGS. 10-13, the internal electronics of the streetlamp of the present invention 10 are externally grounded to a light pole mast via a ground tab 112.

The foregoing detailed description and appended drawings are intended as a description of the presently preferred embodiment of the invention and are not intended to represent the only forms in which the present invention may be constructed and/or utilized. Those skilled in the art will understand that modifications and alternative embodiments of the present invention, which do not depart from the spirit and scope of the foregoing specification and drawings, and of the claims appended below, are possible and practical. It is intended that the claims cover all such modifications and alternative embodiments.

What is claimed is:

1. An outdoor light-emitting diode apparatus comprising:
a housing;
at least one LED module contained within the housing;
means for cooling the at least one LED module;
a heater located inside the housing;
means for activating the heater when the air temperature inside the housing falls below a threshold temperature; and
means for monitoring the at least one LED module wherein the means dims or turns off the at least one LED module if the temperature of the module exceeds a predetermined threshold temperature.

2. The outdoor light-emitting diode apparatus of claim 1, wherein the means for cooling the at least one LED module includes drawing air from a base portion of housing around the at least one LED module and expelling the air from a top portion of the housing.

3. A streetlight for mounting on the mast of a light pole for illuminating the ground below, comprising:
a lamp housing including a main body and a lower cover, wherein the main body includes at least one downwardly extending sidewall and the lower cover includes at least one upwardly extending side wall;
wherein the main body and the lower cover are configured such that there is a gap between the respective sidewalls of the main body and lower cover;
wherein the sidewall of the lower cover is configured such that there is gap between the side wall and an inner surface of the top of the main body;
wherein air is drawn from the exterior of the lamp housing into the interior of the lamp housing by means of the respective gaps;
at least one air outlet opening in the top surface of the main body, wherein air drawn into the gap flows out of the housing;
at least one LED module supported within the main body, wherein air drawn through the gaps flows past the LED module before leaving the housing through the at least one air outlet opening; and
a ballast for driving the at least one LED module.

4. The streetlight of claim 3, wherein the light further includes a heater located inside the housing and means for turning the heater on or off depending upon whether the air temperature inside the lamp housing has fallen below or risen above a predetermined threshold temperature.

5. The streetlight of claim 3, wherein the light further includes means for monitoring the at least one LED module wherein the means dims or turns off the at least one LED module if the temperature of the module exceeds a predetermined threshold temperature.

6. The streetlight of claim 3, wherein the lower cover is pivotally attached to the main body such that the cover may rotate between an open position and a closed position with respect to the main body, wherein access is provided to components contained therein.

7. The streetlight of claim 3, wherein the at least one air outlet opening has a peripheral wall to which a cap may be attached, wherein the cap has a downwardly extending sidewall and is configured so as to maintain a gap between the downwardly extending sidewall of the cap and the peripheral wall of the at least one air outlet opening, wherein air exits the at least one air outlet opening via the gap formed between cap wall and the air outlet peripheral wall.

8. The streetlight of claim 3, wherein a bottom surface of the lower cover includes water drainage apertures.

9. The streetlight of claim 3, wherein a bottom surface of the lower cover includes air inlet apertures.

10. The streetlight of claim 3, wherein at least one LED module(s) is located in the main body and is configured to direct light downwardly from the main body.

11. The streetlight of claim 3, wherein the ballast required to drive the at least one LED module is contained within the main body.

12. The streetlight of claim 3, further including an AC terminal block having AC input terminals mounted on the main body.

13. The streetlight of claim 12, further comprising a heater located adjacent to the AC input terminals.

14. The streetlight of claim 13, further including a heater temperature switch wherein the heater is activated if the air temperature inside the housing falls below a certain threshold temperature.

15. The streetlight of claim 3, further including mast clamps wherein the clamps can be clamped to masts having a diameter within the range of about 1.25 inches to 2.5 inches.

16. An LED lighting device intended for outdoor use, the device comprising:
a lamp housing including a main housing and a lower cover, wherein the main housing includes at least one downwardly extending sidewall and the lower cover includes at least one upwardly extending side wall;
wherein the main housing and the lower cover are configured such that there is a gap between the respective sidewalls of the main housing and lower cover;

wherein the sidewall of the lower cover is configured such that there is gap between the side wall and an inner top surface of the top of the main housing;

wherein air is drawn from the exterior of the lamp housing into the interior of the lamp housing by means of the respective gaps;

at least one air outlet opening in the top surface of the main housing, wherein air drawn into the gap flows out of the housing;

at least one LED module supported within the main housing, wherein air drawn through the gaps flows past the LED module before leaving the housing through the at least one air outlet opening;

a heater located inside the housing; and a thermal temperature switch wherein the heater is activated if the air temperature inside the housing falls below a preset threshold temperature.

17. The LED lighting device of claim 16, further including an AC terminal block located inside wherein the heater is located adjacent to the AC terminal block.

18. The LED lighting device of claim 16, further including means for monitoring the at least one LED module wherein the means dims or turns off the at least one LED module if the temperature of the module exceeds a predetermined threshold temperature.

19. The LED lighting device of claim 16, further including a mast compartment cover which encloses clamps capable of attachment to a mast, wherein the clamps can be clamped to masts having a diameter within the range of about 1.25 inches to 2.5 inches.

20. The streetlight of claim 16, wherein the at least one air outlet opening has a peripheral wall to which a cap may be attached, wherein the cap has a downwardly extending sidewall and is configured so as to maintain a gap between the downwardly extending sidewall of the cap and the peripheral wall of the at least one air outlet opening, wherein air exits the at least one air outlet opening via the gap formed between cap wall and the air outlet peripheral wall, whereby the cap prevents dust and water from entering the housing.

21. The streetlight of claim 16, wherein the combined area of the at least one air outlet openings should be within the range of about 25% of the surface area of the at least one LED module(s) to about 75% of the surface area of the at least one LED module(s).

* * * * *